US008075376B1

(12) United States Patent
Inzeo

(10) Patent No.: US 8,075,376 B1
(45) Date of Patent: Dec. 13, 2011

(54) CUSTOMIZABLE RIDGE VENTILATOR

(75) Inventor: Joseph A. Inzeo, West Allis, WI (US)

(73) Assignee: Metal-Era, Inc., Waukesha, WI (US)

( * ) Notice: Subject to any disclaimer, the term of this patent is extended or adjusted under 35 U.S.C. 154(b) by 970 days.

(21) Appl. No.: 11/836,839

(22) Filed: Aug. 10, 2007

Related U.S. Application Data

(60) Provisional application No. 60/878,771, filed on Jan. 5, 2007.

(51) Int. Cl.
*F24F 13/08* (2006.01)

(52) U.S. Cl. ..... 454/367

(58) Field of Classification Search ..... 454/339, 454/340, 365, 364, 367, 366, 333; 52/198, 52/199

See application file for complete search history.

(56) References Cited

U.S. PATENT DOCUMENTS 4,545,291 A * 10/1985 Kutsch et al. ..... 454/365
4,558,637 A * 12/1985 Mason ..... 454/365
5,052,286 A * 10/1991 Tubbesing et al. ..... 454/365
5,092,225 A * 3/1992 Sells ..... 454/365
5,112,278 A * 5/1992 Roberts ..... 454/365
5,427,571 A 6/1995 Sells ..... 454/365
5,568,706 A * 10/1996 Gerhing et al. ..... 52/198
5,706,618 A * 1/1998 Pratt ..... 52/199
5,803,806 A * 9/1998 Blessinger ..... 454/365
6,240,690 B1 * 6/2001 James et al. ..... 52/302.3

* cited by examiner

*Primary Examiner* — Steven B McAllister
*Assistant Examiner* — Brittany E Towns
(74) *Attorney, Agent, or Firm* — Donald J. Ersler

(57) ABSTRACT

A customizable ridge ventilator includes a pair of support brackets, a perforated support and a ridge cover. A bottom of one support bracket is attached to one side of a ventilation opening and the other support bracket is attached to the other side of the ventilation opening. The perforated support is a formed plate with a plurality of perforated openings. The perforated support is attached to a top of the pair of support brackets. The ridge cover includes snap clips that are sized to receive snap flanges extending from the perforated support. A top of the perforated support, supports a bottom surface of the ridge cover. A second embodiment of the customizable ridge ventilator includes a pair of support brackets for corrugated roof applications.

19 Claims, 10 Drawing Sheets

CUSTOMIZABLE RIDGE VENTILATOR

CROSS-REFERENCES TO RELATED APPLICATIONS

This is a utility patent application taking priority from provisional application No. 60/878,771 filed on Jan. 5, 2007.

BACKGROUND OF THE INVENTION

1. Field of the Invention

The present invention relates generally to roof ventilation and more specifically to a customizable ridge ventilator, which may be modified to accommodate different roof pitches and air flow requirements.

2. Discussion of the Prior Art

Proper ventilation of a roof prevents premature failure of roofing materials (such as shingles) due to excessive heat; moisture due to condensation, thus preventing a major source of mold and mildew; and ice damming in cold climates, which also leads to premature failure of roofing materials. Some of the factors that dictate ventilation requirements include roof size, attic space area, length of roof ridge, length of roof eaves, pitch of roof, the amount of insulation below the roof, exposure to sun, climate, humidity and temperature extremes.

There are numerous ridge ventilators in the art. U.S. Pat. No. 5,427,571 to Sells discloses a ventilated cap system for the ridge of a roof. The Sells patent includes an expandable utility cap to seal over a variably expanding metal roof. In one form, a top cap may snap lock over the utility cap for slidable attachment thereto when exposed to deforming forces such as ice or snow. The top cap prevents deformation of the underlying utility cap. However, the Sells ridge ventilator is not easily customizable.

Accordingly, there is a clearly felt need in the art for a customizable ridge ventilator, which may be easily modified to accommodate different ventilation factors.

SUMMARY OF THE INVENTION

The present invention provides a customizable ridge ventilator, which may be modified to accommodate different roof pitches and air flow requirements. The customizable ridge ventilator includes a pair of support brackets, a perforated support and a ridge cover. Each support bracket has a substantial Z-shaped cross section. A bottom of one support bracket is attached to one side of a ventilation opening and a bottom of the other support bracket is attached to the other side of the ventilation opening. The perforated support is a formed plate with a plurality of perforated openings. The perforated support preferably has a cross section with a support peak, a pair of legs and a pair of snap flanges. One end of a leg extends from a bottom of each side of the support peak. A snap flange extends downward from the other end of each leg. The perforated support is attached to a top of the pair of support brackets with fasteners or the like.

The ridge cover includes a sloped peak, two side legs and a pair of snap clips. One end of a single side leg extends downward from each end of the sloped peak. A single snap clip extends from the other end of each side leg. The pair of snap clips of the ridge cover are slid over the pair of snap flanges of the perforated support. A top of the support peak supports the ridge cover. A cover splice includes a cross section that has the same shape as the ridge cover. The cover splice is sized to be received by an inner perimeter of the ridge cover. Two adjacent ridge covers are connected to each other with the cover splice.

A second embodiment of the customizable ridge ventilator includes a pair of support brackets, the perforated support and the ridge cover. Each support bracket has a substantial C-shaped cross section. The second embodiment of the customizable ridge ventilator includes corrugated roof applications. A bottom of one support bracket is attached to one side of a ventilation opening and a bottom of the other support bracket is attached to the other side of the ventilation opening, such that the open ends face away from each other. The open end of each support bracket is sized to receive a thickness of a corrugated roof panel. The perforated support is attached to a top of the pair support brackets. The pair of snap clips of the ridge cover snap are slid over the pair of snap flanges of the perforated support. A top of the support peak supports the ridge cover. Two adjacent ridge covers are connected to each other with the cover splice.

Accordingly, it is an object of the present invention to provide a customizable ridge ventilator, which may be easily modified to accommodate different ventilation factors.

These and additional objects, advantages, features and benefits of the present invention will become apparent from the following specification.

DETAILED DESCRIPTION OF THE PREFERRED EMBODIMENTS

Figure 1:
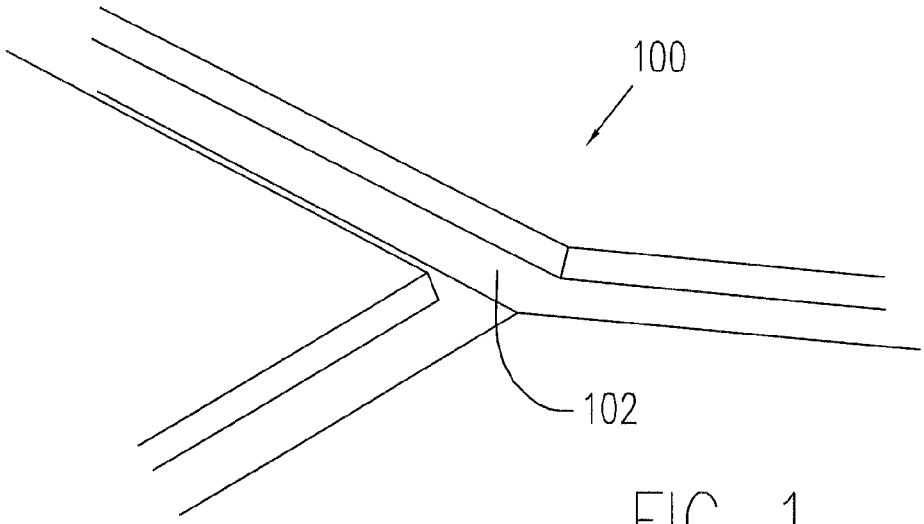
FIG. 1 is a perspective view of a roof with a ventilation opening for attachment of a customizable roof ventilator in accordance with the present invention.
Figure 2:
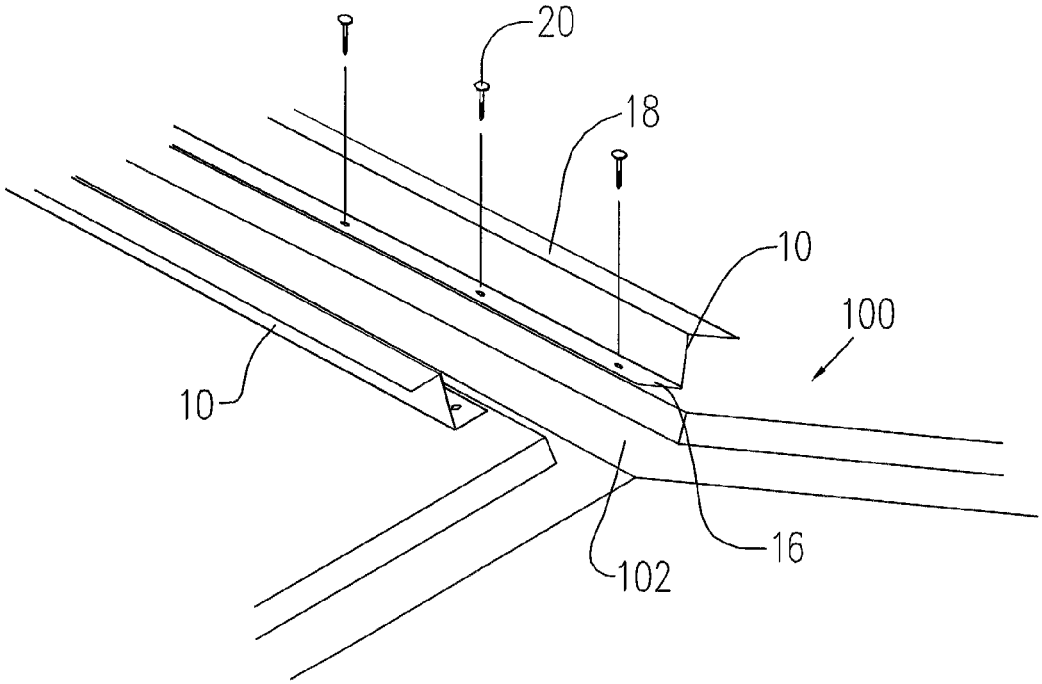
FIG. 2 is a perspective view of a pair of support brackets positioned on a roof of a customizable roof ventilator in accordance with the present invention.
Figure 3:
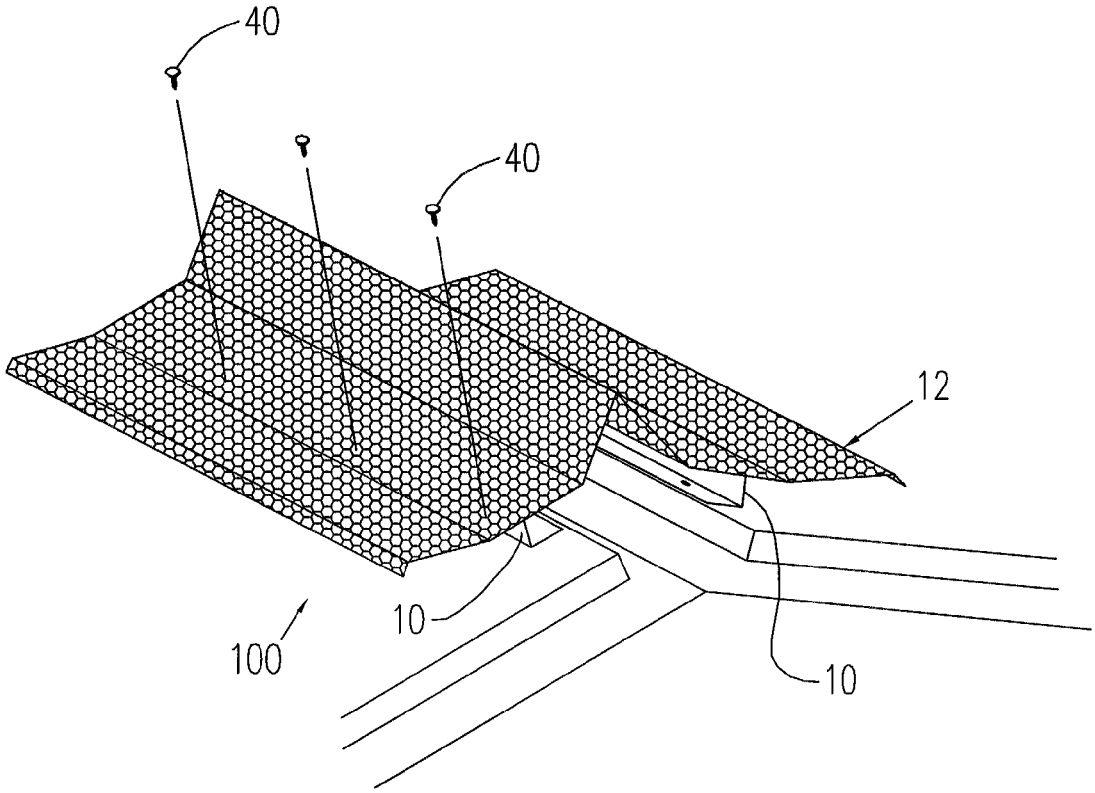
FIG. 3 is a perspective view of a perforated support positioned on a pair of support brackets of a customizable roof ventilator in accordance with the present invention.
Figure 8:
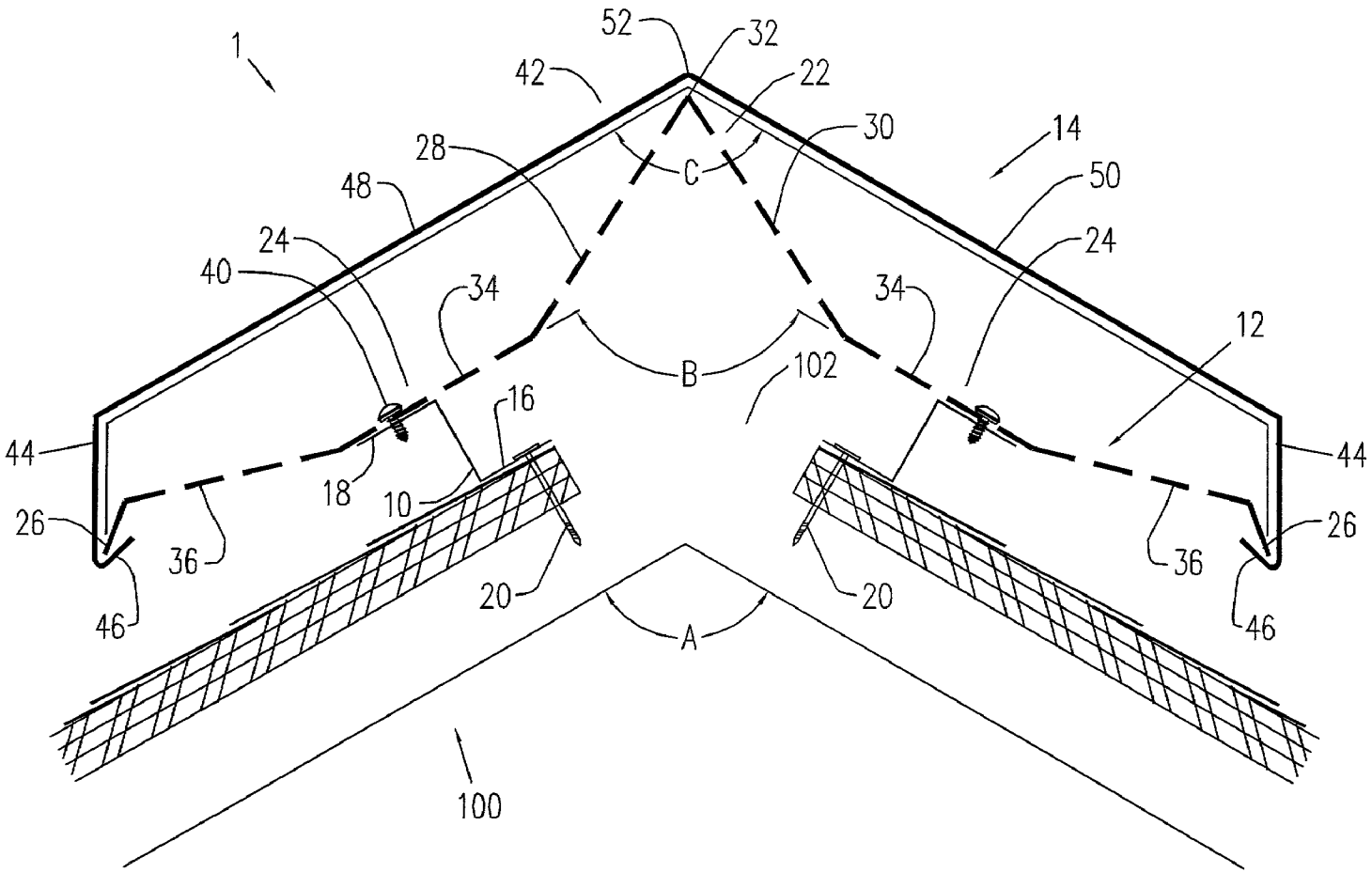
FIG. 8 is an end view of a customizable roof ventilator attached to a roof in accordance with the present invention.

With reference now to the drawings, and particularly to FIG. 8, there is shown an end view of a customizable roof ventilator 1 attached to a roof 100. With reference to FIGS. 1-3, the customizable ridge ventilator 1 includes a pair of support brackets 10, a perforated support 12 and a ridge cover 14. Each support bracket 10 has a substantial Z-shaped cross section. A bottom flange 16 of the support bracket 10 extends in a direction opposite of the top flange 18 of the support bracket 10. The bottom flange 16 is attached to a top of the roof 100 with a plurality of fasteners 20. One support bracket 10 is attached to one side of a ventilation opening 102 and the other support bracket 10 is attached to the other side of the ventilation opening 102.

The perforated support 12 is a formed plate with a plurality of perforated openings. It is preferable that the plurality of perforated openings occupy 45-55% of the surface area of the perforated support 12. The perforated support 12 preferably has a cross section with a support peak 22, a pair of legs 24 and a pair of snap flanges 26. The support peak 22 includes a first face 28 and a second face 30 that meet at a face peak 32. One end of the leg 24 extends from a bottom of each face of the support peak 22. The leg 24 includes a bracket member 34 and a flange member 36. The snap flange 26 extends downward from the flange member 36. The perforated support 12 is attached to a top of the pair of support brackets 10 by inserting a plurality of threaded fasteners through the pair of bracket members 34 and threading the plurality of threaded fasteners 40 into the top flanges 18 of the pair of support brackets 10.

Figure 6:
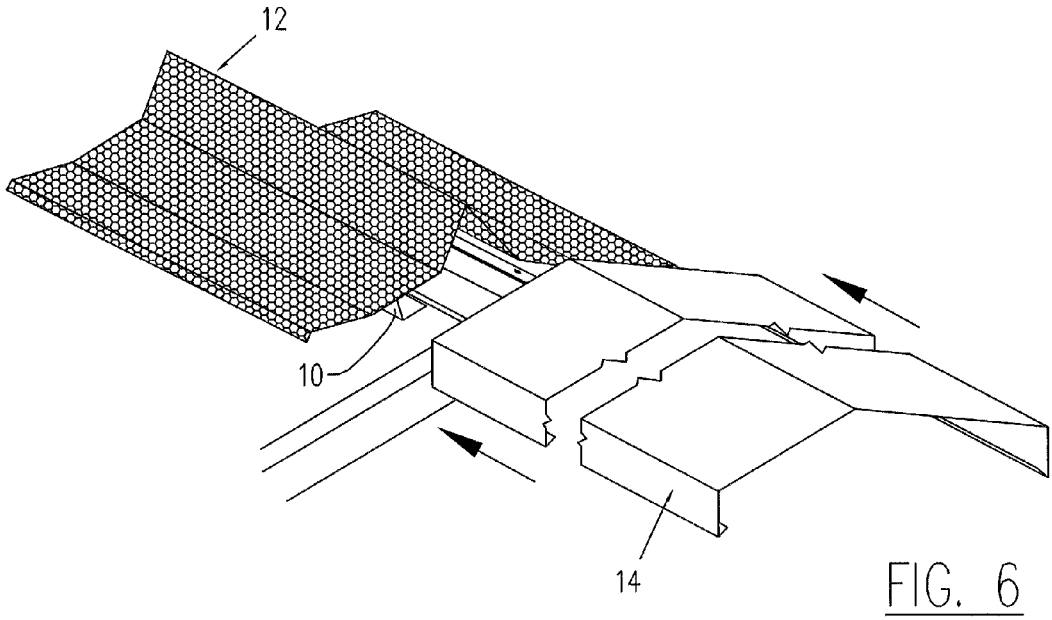
FIG. 6 is a perspective view of a ridge cover adjacent a perforated support of a customizable roof ventilator in accordance with the present invention.

The ridge cover 14 includes a sloped peak 42, two side legs 44 and a pair of snap clips 46. The sloped peak 42 includes a first face 48 and a second face 50 that meet at a cover peak 52. One end of a single side leg 44 extends downward from each face of the sloped peak 42. Each side leg 44 is terminated with a snap clip 46. With reference to FIG. 6, the pair of snap clips 46 of the ridge cover 14 are slid over the pair of snap flanges 26 of the perforated support 12. The face peak 32 supports an underside of the cover peak 52. The perforated support 12 has sufficient rigidity to support the ridge cover 14.

With reference to FIG. 8, the included angle "A" of the roof 100 is preferably replicated during manufacture of the customizable roof ventilator 1 by defining the included angle "B" of the bracket members 34 of the perforated support 12 as "B"="A" and by defining the included angle "C" of the first and second faces of the ridge cover 14 as "C"="A."

Figure 4:
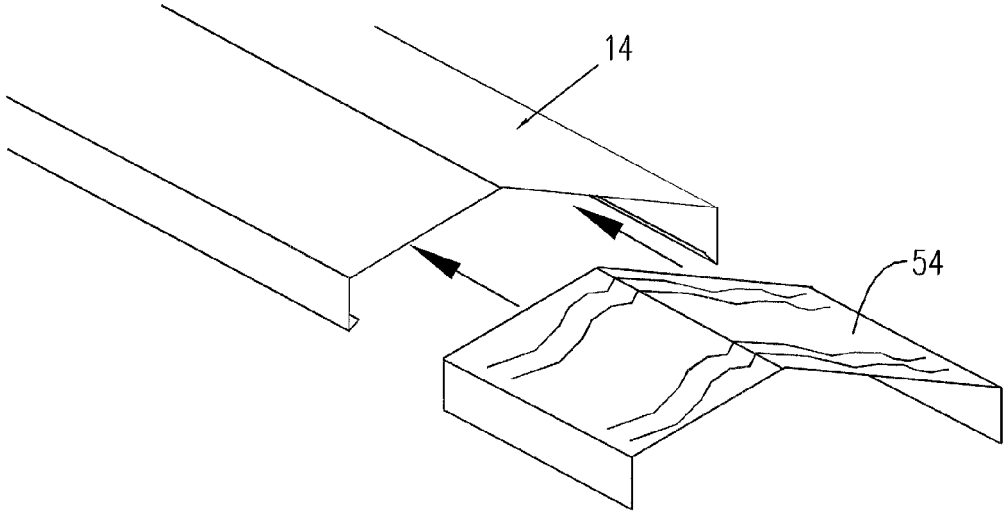
FIG. 4 is a perspective view of a cover splice adjacent a ridge cover of a customizable roof ventilator in accordance with the present invention.
Figure 5:
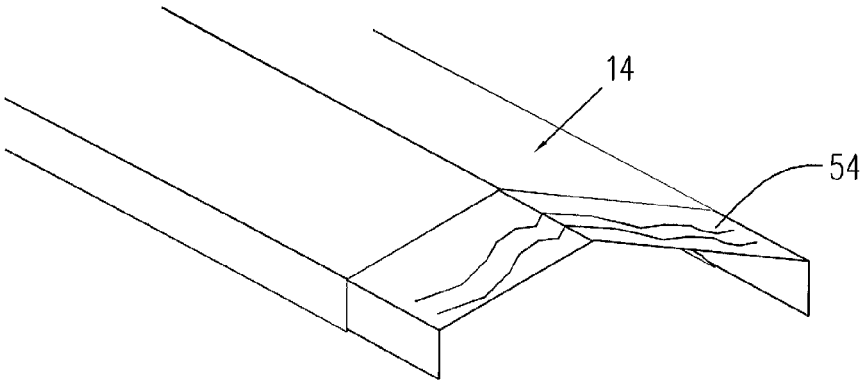
FIG. 5 is a perspective view of a cover splice inserted into a ridge cover of a customizable roof ventilator in accordance with the present invention.
Figure 7:
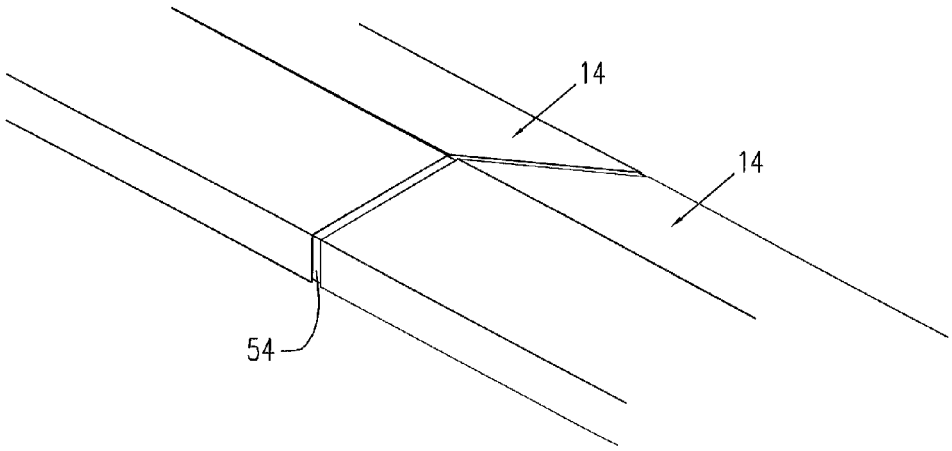
FIG. 7 is a perspective view of two adjacent ridge covers engaged with a cover splice of a customizable roof ventilator in accordance with the present invention.

With reference to FIGS. 4-5, a cover splice 54 includes a cross section that has the same shape as the ridge cover 14. However, the cover splice 54 does not include a pair of snap clips 46. The cover splice 54 is sized to be received by an inner perimeter of the ridge cover 14. With reference to FIG. 7, two adjacent ridge covers 14 are connected to each other with the cover splice 54.

Figure 9:
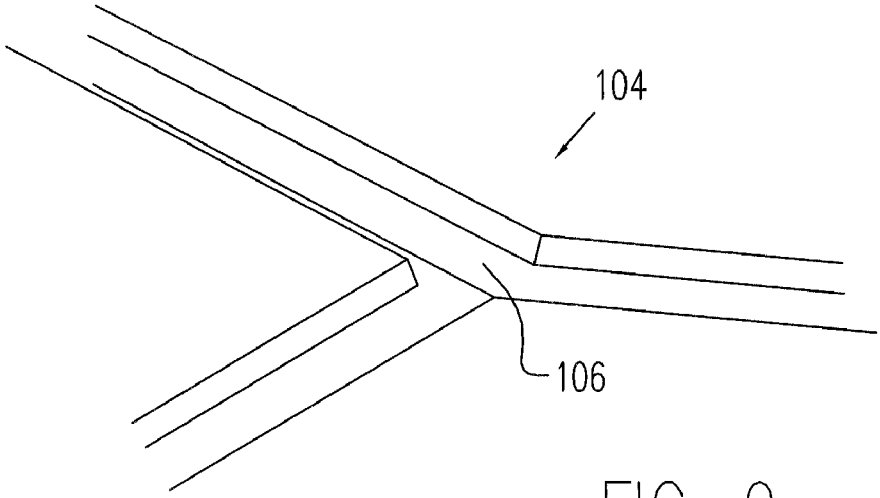
FIG. 9 is a perspective view of a roof with a ventilation opening for attachment of a second embodiment of a customizable roof ventilator in accordance with the present invention.
Figure 10:
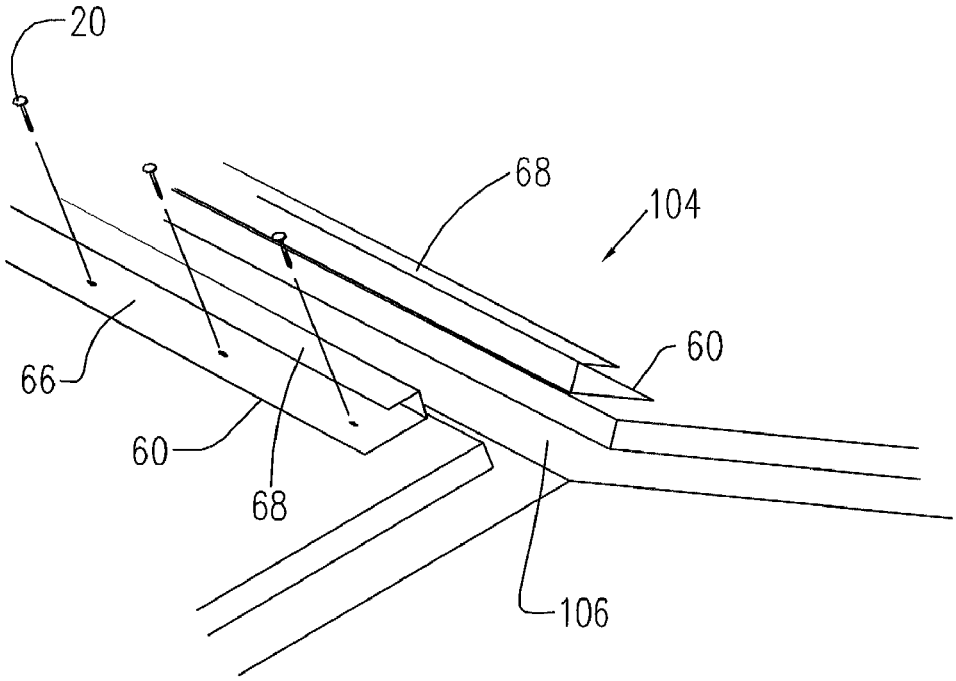
FIG. 10 is a perspective view of a pair of support brackets positioned on a roof of a second embodiment of a customizable roof ventilator in accordance with the present invention.
Figure 11:
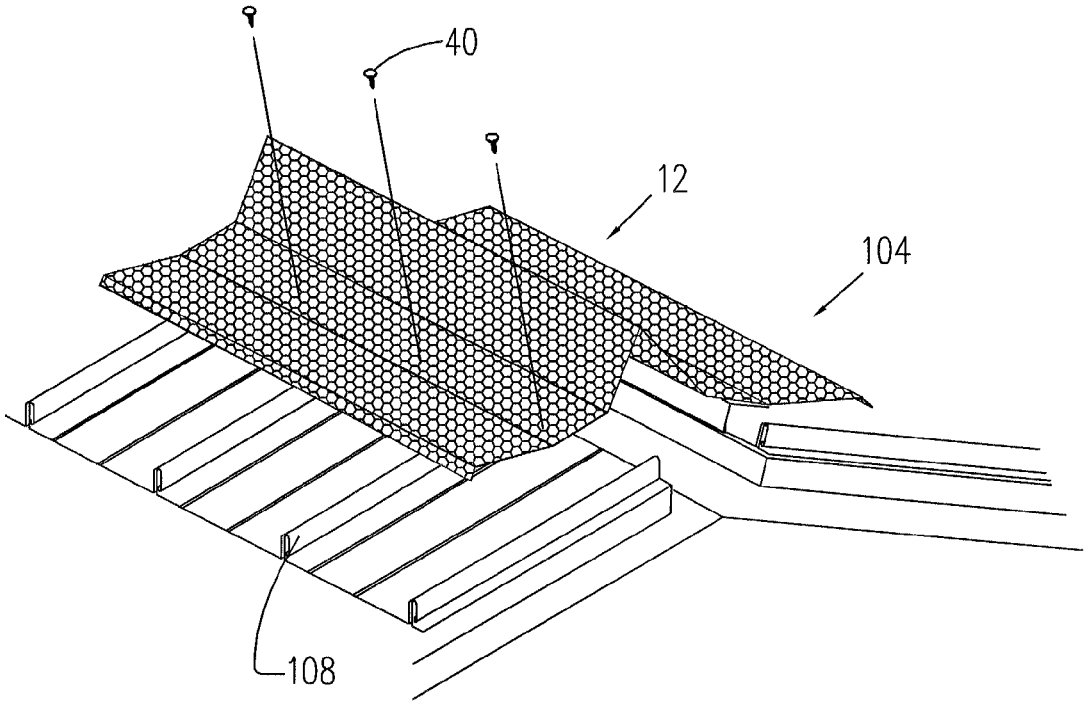
FIG. 11 is a perspective view of a perforated support positioned on a pair of support brackets and over a corrugated roof of a second embodiment of a customizable roof ventilator in accordance with the present invention.
Figure 16:
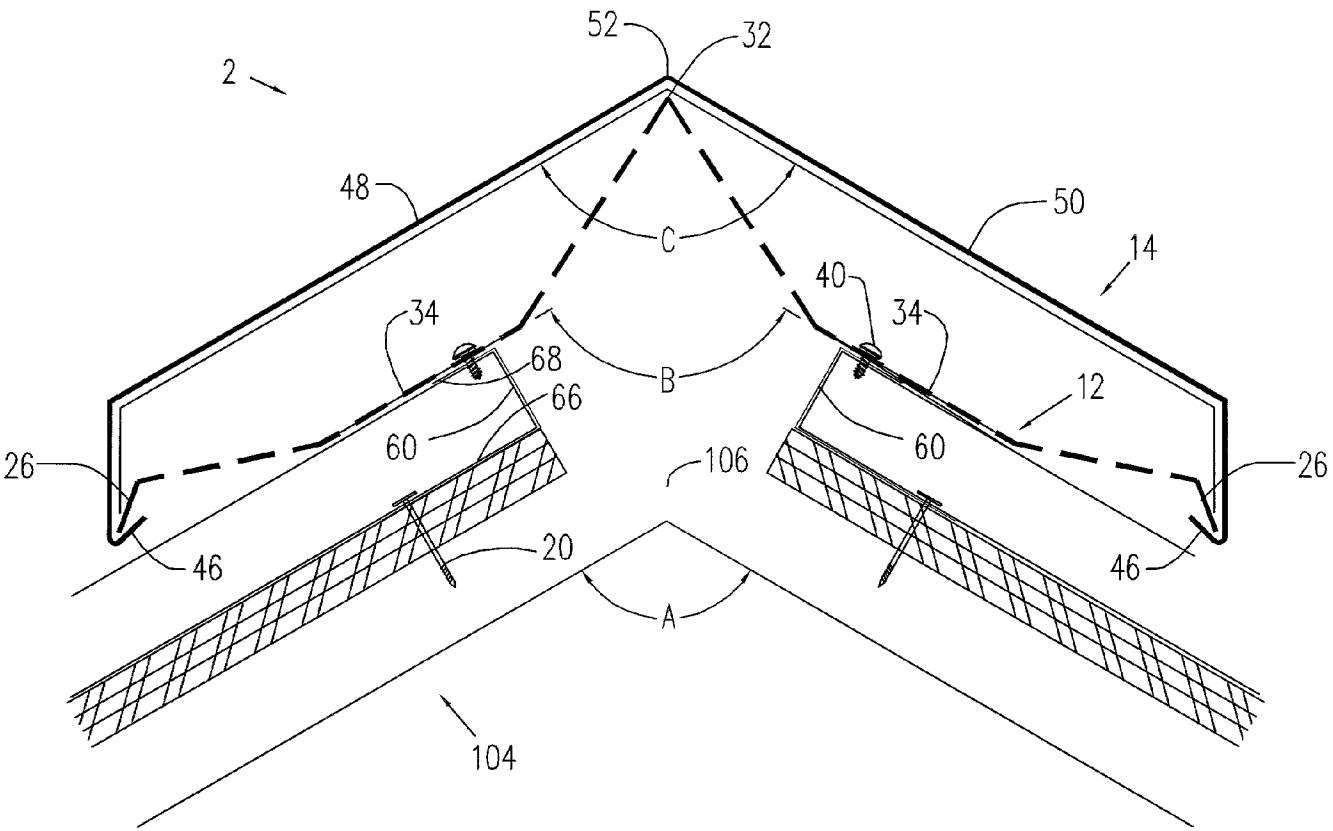
FIG. 16 is an end view of a second embodiment of a customizable roof ventilator attached to a roof in accordance with the present invention.

With reference to FIG. 16, a second embodiment of the customizable ridge ventilator 2 includes a pair of support brackets 60, the perforated support 12 and the ridge cover 14, which are structured for attachment to a corrugated roof 104. With reference to FIGS. 9-11, the bottom flange 66 is attached to a top of the corrugated roof 104 with a plurality of fasteners 20. One support bracket 60 is attached to one side of a ventilation opening 106 and the other support bracket 60 is attached to the other side of the ventilation opening 106, such that the open ends face away from each other. The open end of each support bracket 60 is sized to receive a thickness of a corrugated roof panel 108.

Figure 14:
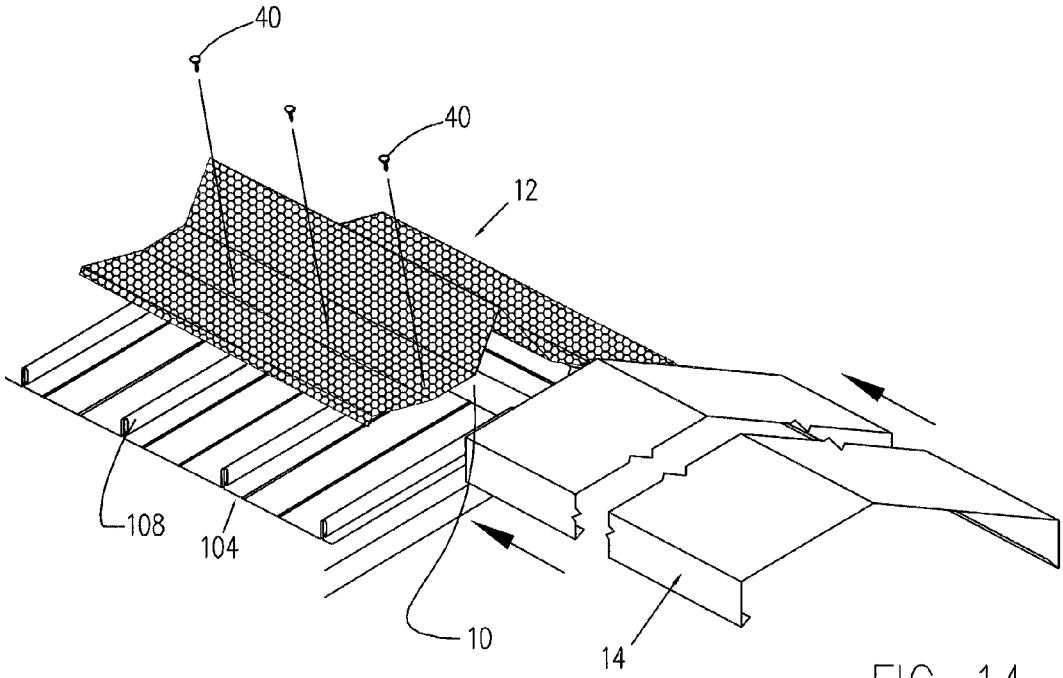
FIG. 14 is a perspective view of a ridge cover adjacent a perforated support of a second embodiment of a customizable roof ventilator in accordance with the present invention.

The perforated support 12 is attached to a top bracket 68 of the pair of support brackets 10 by inserting a plurality of threaded fasteners 40 through the bracket members 34 and threading the plurality of threaded fasteners 40 into the top flanges 68 of the support brackets 60. With reference to FIG. 14, the pair of snap clips 46 of the ridge cover 14 are slid over the pair of snap flanges 26 of the perforated support 12. The face peak 32 supports an underside of the cover peak 52.

Figure 12:
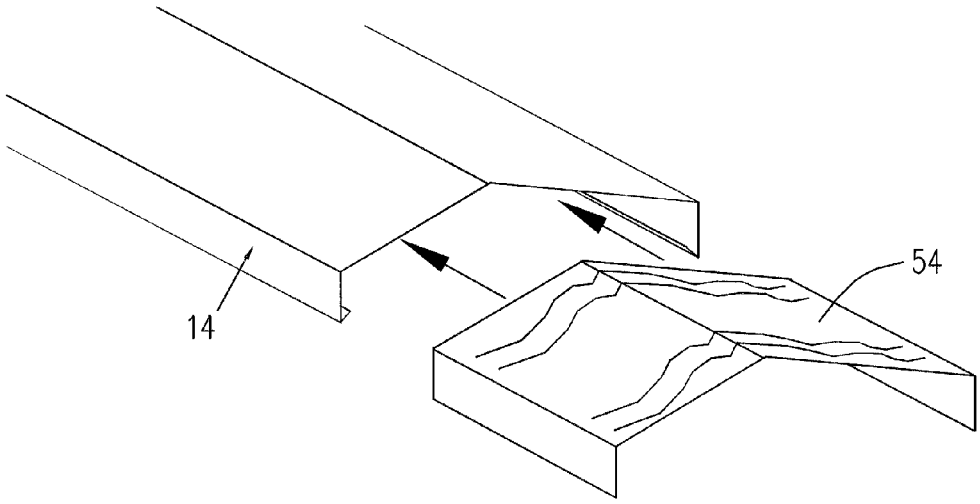
FIG. 12 is a perspective view of a cover splice adjacent a ridge cover of a second embodiment of a customizable roof ventilator in accordance with the present invention.
Figure 13:
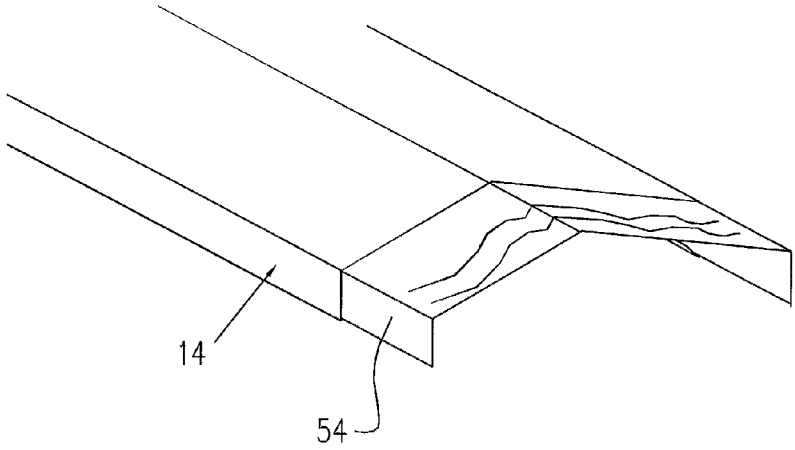
FIG. 13 is a perspective view of a cover splice inserted into a ridge cover of a second embodiment of a customizable roof ventilator in accordance with the present invention.
Figure 15:
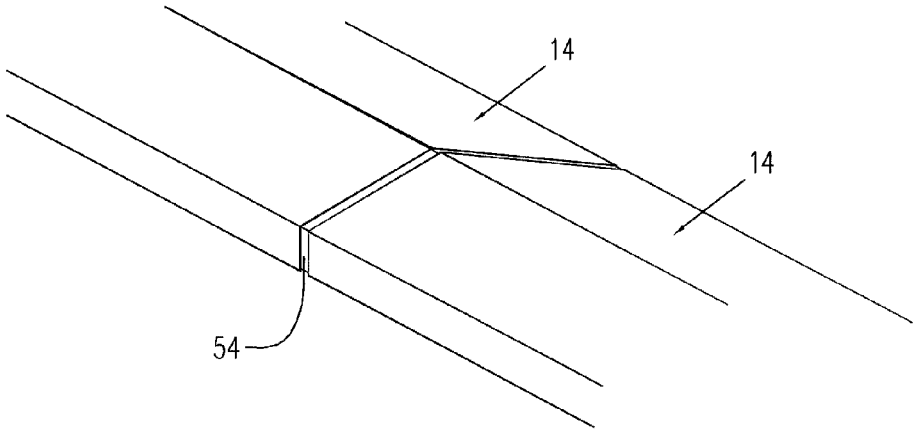
FIG. 15 is a perspective view of two adjacent ridge covers engaged with a cover splice of a second embodiment of a customizable roof ventilator in accordance with the present invention.

With reference to FIG. 16, the included angle "A" of the roof 104 is preferably replicated during manufacture of the customizable roof ventilator 2 by defining the included angle "B" of the bracket members 34 of the perforated support 12 as "B"="A" and by defining the included angle "C" of the first and second faces of the ridge cover 14 as "C"="A." With reference to FIGS. 12-13 and 15, two adjacent ridge 14 covers are connected to each other with the cover splice 54.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A ridge ventilator for a roof comprising:

a first support bracket for attachment to the roof;

a second support bracket for attachment to the roof;

a perforated support for attachment to a top of said first and second support brackets, said perforated support including a plurality of openings and a face peak, said plurality of openings are formed through all of a surface area of said perforated support, said plurality of openings providing a ventilation path for an area underneath of said ridge ventilator to an area under said face peak, said face peak extending upward from said perforated support; and a ridge cover being supported by a top of said face peak, said ridge cover being engagable with said perforated support.

2. The ridge ventilator for a roof of claim 1, further comprising:

a pair of snap flanges extending from each end of said perforated support.

3. The ridge ventilator for a roof of claim 2, further comprising:

a pair of snap clips extending from each end of said ridge cover, said pair of snap clips for engagement with said pair of snap flanges.

4. The ridge ventilator for a roof of claim 1, further comprising:

said perforated support including a first bracket member extending from one side of said face peak and a second bracket member extending from the other side of said face peak.

5. The ridge ventilator for a roof of claim 4 wherein:

an included angle of said first and second bracket members being matched to an included angle of the roof.

6. The ridge ventilator for a roof of claim 1, further comprising:

said ridge cover including a first face and a second face that meet at a cover peak.

7. The ridge ventilator for a roof of claim 1, further comprising:

said first and second support bracket having substantially C-shaped cross sections.

8. The ridge ventilator for a roof of claim 1, further comprising:

said first and second support bracket having substantially Z-shaped cross sections.

9. A ridge ventilator for a roof comprising:

a first support bracket for attachment to the roof;

a second support bracket for attachment to the roof;

a perforated support for attachment to a top of said first and second support brackets, said perforated support including a first leg, a second leg, and a face peak, said first leg extends from one end of said face peak, said second leg extends from the other end of said face peak, said plurality of openings are formed through substantially all of a surface area of said perforated support, said face peak extending upward from said perforated support; and a ridge cover including a first face and a second face, one end of said first face meets one end of said second face to form a cover peak, said cover peak being supported by and in contact with a top of said face peak, said first leg is substantially parallel to said first face and a first portion of the roof, said second leg is substantially parallel to said second face and a second portion of the roof.

10. The ridge ventilator for a roof of claim 9, further comprising:

a pair of snap flanges extending from each end of said perforated support.

11. The ridge ventilator for a roof of claim 10, further comprising:

a pair of snap clips extending from each end of said ridge cover, said pair of snap clips for engagement with said pair of snap flanges.

12. The ridge ventilator for a roof of claim 9, further comprising:

said ridge cover including a first face and a second face that meet at a cover peak.

13. A ridge ventilator for a roof comprising:

a first support bracket for attachment to the roof;

a second support bracket for attachment to the roof;

a perforated support for attachment to a top of said first and second support brackets, said perforated support including a plurality of openings and a face peak, said plurality of openings are formed through substantially all of a surface area of said perforated support, said face peak extending upward from said perforated support; and a ridge cover including a first face and a second face, one end of said first face meets one end of said second face to form a cover peak, said cover peak being supported by a top of said face peak, said ridge cover being engagable with said perforated support, said first leg is substantially parallel to said first face and a first portion of the roof, said second leg is substantially parallel to said second face and a second portion of the roof, wherein air passes between at least one of said first leg and a first portion of the roof and at least one of said second leg and a second portion of the roof.

14. The ridge ventilator for a roof of claim 13, further comprising:

a pair of snap clips extending from each end of said ridge cover, said pair of snap clips for engagement with a pair of snap flanges extending from each end of said perforated support.

15. The ridge ventilator for a roof of claim 13, further comprising:

said perforated support including a first bracket member extending from one side of said face peak and a second bracket member extending from the other side of said face peak.

16. The ridge ventilator for a roof of claim 13 wherein:

an included angle of said first and second bracket members being matched to an included angle of the roof.

17. The ridge ventilator for a roof of claim 13, further comprising:

said ridge cover including a first face and a second face that meet at a cover peak.

18. The ridge ventilator for a roof of claim 9, further comprising:

said perforated support including a first bracket member extending from one side of said face peak and a second bracket member extending from the other side of said face peak.

19. The ridge ventilator for a roof of claim 18, further comprising:

an included angle of said first and second bracket members being matched to an included angle of the roof.

* * * * *